US011197544B2

(12) United States Patent
Phan et al.

(10) Patent No.: US 11,197,544 B2
(45) Date of Patent: Dec. 14, 2021

(54) UNIVERSAL VANITY/CABINET ACCOMMODATING BOTH LEFT SIDE AND RIGHT SIDE DRAWER MOUNTING

(71) Applicant: Home Plus Group, Inc., Fountain Valley, CA (US)

(72) Inventors: Tin Huu Phan, Westminster, CA (US); Tram Hong Nguyen, Garden Grove, CA (US)

(73) Assignee: Home Plus Group, Inc., Fountain Valley, CA (US)

( * ) Notice: Subject to any disclaimer, the term of this patent is extended or adjusted under 35 U.S.C. 154(b) by 0 days.

(21) Appl. No.: 16/545,881

(22) Filed: Aug. 20, 2019

(65) Prior Publication Data

US 2021/0052069 A1 Feb. 25, 2021

(51) Int. Cl.

| | |
|---|---|
| ***A47B 67/04*** | (2006.01) |
| ***A47B 77/06*** | (2006.01) |
| *A47B 88/40* | (2017.01) |

(52) U.S. Cl.

CPC ..... *A47B 67/04* (2013.01); *A47B 77/06* (2013.01); *A47B 88/40* (2017.01)

(58) Field of Classification Search

CPC ..... A47B 67/04; A47B 77/06; A47B 88/40; A47B 77/00; A47B 77/02; A47B 2220/03

USPC ..... 312/330.1, 257.1, 363, 240

See application file for complete search history.

(56) References Cited

U.S. PATENT DOCUMENTS 2,620,251 A * 12/1952 Restivo ..... A47B 47/00 312/240
3,062,608 A * 11/1962 Magaline ..... A47K 1/02 312/205
3,063,768 A * 11/1962 Moore, Jr. ..... A47B 77/02 312/111
3,437,392 A * 4/1969 Hilfinger ..... A47B 88/9414 312/258
3,612,634 A * 10/1971 Moore, Jr. ..... A47B 47/00 312/111

(Continued)

FOREIGN PATENT DOCUMENTS

DE 2042208 * 3/1972

OTHER PUBLICATIONS

Face frame webpage Wikipedia; https://en.wikipedia.org/wiki/Face_frame (Year: 2017).*

*Primary Examiner* — Janet M Wilkens
(74) *Attorney, Agent, or Firm* — Merek, Blackmon & Voorhees, LLC

(57) ABSTRACT

A universal cabinet accommodating both left and right side drawer mountings allowing the universal cabinet to be installed in a first installation site requiring left side drawer mounting and a second installation site requiring right side drawer mounting. The universal cabinet preferably includes a cabinet housing having an interior space and an upper opening. The upper opening is preferably configured to receive at least one sink. The interior space is sized to receive an interior portion of at least one drawer and plumbing to be connected to the at least one sink. The cabinet housing preferably includes a frame member configured to mount one or more drawers on a left side of the cabinet housing when an installation site requires left side drawer mounting and on a right side of the cabinet housing when an installation site requires right side drawer mounting.

20 Claims, 7 Drawing Sheets

(56) References Cited

U.S. PATENT DOCUMENTS

| | | | | | |
|---|---|---|---|---|---|
| 3,700,300 | A * | 10/1972 | Davis | A47B 57/08 | 312/240 |
| 3,743,373 | A * | 7/1973 | Camper | A47B 47/05 | 312/265.1 |
| 3,749,465 | A * | 7/1973 | Newcomer | A47B 47/00 | 312/245 |
| 4,844,565 | A * | 7/1989 | Brafford | A47B 87/008 | 312/107.5 |
| 5,277,487 | A * | 1/1994 | Simon | A47B 67/00 | 29/434 |
| 7,240,380 | B2 * | 7/2007 | Erickson | A47B 77/06 | 4/631 |
| 2003/0209957 | A1 * | 11/2003 | Hightower | A47B 67/04 | 312/334.7 |
| 2005/0099101 | A1 * | 5/2005 | Lowe | A47K 1/02 | 312/228 |
| 2005/0184630 | A1 * | 8/2005 | Bonanno | A47B 57/32 | 312/408 |
| 2007/0175075 | A1 * | 8/2007 | Sturdivant | G09F 15/0012 | 40/492 |
| 2008/0224581 | A1 * | 9/2008 | Minerva | A47B 97/00 | 312/229 |
| 2011/0145988 | A1 * | 6/2011 | Le Duff | A47B 77/06 | 4/630 |
| 2012/0079650 | A1 * | 4/2012 | Metcalf | E03D 13/00 | 4/311 |
| 2013/0097906 | A1 * | 4/2013 | Schultz | A47G 1/0605 | 40/747 |
| 2013/0257243 | A1 * | 10/2013 | Bader | A47B 47/042 | 312/265.2 |

* cited by examiner

UNIVERSAL VANITY/CABINET ACCOMMODATING BOTH LEFT SIDE AND RIGHT SIDE DRAWER MOUNTING

FIELD OF THE INVENTION

A preferred form of the present invention is directed to a vanity or cabinet that includes one or more drawers on one side of the cabinet/vanity and one or more doors or other closure on the other side of cabinet/vanity where the one or more doors/closures cover an enlarged opening and may provide access to an interior cabinet/vanity space. The preferred form of the present invention allows the same cabinet/vanity to be installed in an installation site regardless of whether the installation site requires the one or more drawers to be mounted on the left side or the right side of the cabinet/vanity due to the location of one or more plumbing components or other existing structure. In a most preferred form of the present invention, the vanity or cabinet is a bathroom vanity/cabinet having one or more sinks.

BACKGROUND OF THE INVENTION

A wide variety of vanities/cabinets have been previously designed to house plumbing that connects to one or more sinks. These vanities include one or more doors that cover an interior space and allow an individual to access plumbing housed in the interior space behind the one or more doors. On the opposite side of the one or more doors, vanities typically include one or more drawers that provide storage space that an individual can readily access by merely sliding the drawer between a closed position and an open position.

Existing vanities/cabinets are specifically designed to be installed such that the one or more drawers can only be mounted on one side the vanity/cabinet. Therefore, when purchasing a vanity or cabinet a customers must specify whether the vanity/cabinet is to have a left side mounting for mounting one or more drawers or a right side mounting for mounting one or more drawers based on the location of existing structure (e.g., one or more plumbing components) at the installation site of the vanity or cabinet so the one or more drawers will be sufficiently offset from any existing structure to allow the one or more drawers to be freely opened and closed without hitting or rubbing up against any existing structure (e.g., one or more plumbing pipes).

Often, the contractor and/or the d-i-y customer buy/order the wrong side drawer cabinet. This is obviously a significant problem as the customer or contractor must reorder the correct cabinet causing significant delay in completion of the project. This may require additional travel to the cabinet supplier/distributor/manufacturer to return the wrong product and pick-up the correct product. Even where the correct product is shipped directly to the contractor or d-i-y customer, the delay in receiving the correct product can be significant.

Also, where the error is that of the customer or contractor, the cabinet supplier/distributor/manufacturer may not refund the money to the customer or contractor that ordered the wrong product. For example, many suppliers do not even allow exchanges or returns once the product has been opened. For those suppliers that do allow exchanges or returns, a hefty restocking fee may be assessed for the returned product.

Also, the cabinet/vanity supplier may provide the customer or contractor with the wrong side drawer cabinet.

While the supplier may provide the correct side drawer cabinet at no cost, there will still be a significant delay in the completion of the project.

Regardless of whether the error in ordering the product was that of the contractor, d-i-y customer or the supplier, the customer will likely become dissatisfied with the product, the supplier and/or the contractor negatively impacting future sales of the supplier and/or negatively impacting future work for the contractor.

Hence, there is a significant need for a product that prevents a contractor, d-i-y customer or other individual from ordering the wrong vanity/cabinet.

OBJECTS AND SUMMARY OF THE INVENTION

An object of the present invention is to provide a novel and unobvious vanity or cabinet.

Another object of a preferred embodiment of the present invention is to provide a vanity or cabinet that can accommodate both left drawer mounting for mounting one or more drawers on a left side of the vanity or cabinet and right drawer mounting for mounting one or more drawers on a right side of the vanity or cabinet.

A further object of a preferred embodiment of the present invention is to provide a bathroom vanity that includes at least one sink and at least one drawer wherein the bathroom vanity is configured to allow both left and right drawer mounting to allow the same bathroom vanity to be used regardless of whether existing installation site structure requires the at least one drawer to be mounted on the left side or the right side of the bathroom vanity.

Yet another object of a preferred embodiment of the present invention is to provide a vanity or cabinet having an adjustable panel or other housing member forming at least a portion of the housing of the vanity or cabinet wherein when the adjustable panel or housing member is in a first position the vanity or cabinet enables left side drawer mounting and in a second position the vanity or cabinet enables right side drawer mounting.

Still a further object of a preferred embodiment of the present invention is to provide a vanity or cabinet having at least one adjustable housing member forming at least a portion of the housing of the vanity or cabinet wherein when the adjustable housing member is in a first position the vanity or cabinet enables left side drawer mounting and when the adjustable housing member is rotated a predeterminer number of degrees (e.g., 180 degrees) from the first position to assume a second position the vanity or cabinet enables right side drawer mounting.

Still yet a further object of a preferred embodiment of the present invention is to provide a vanity or cabinet having at least one adjustable front housing member forming at least a portion of the front of the housing of the vanity or cabinet and a rear housing member wherein the adjustable front housing member is configured to accommodate both left and right side drawer mounting by merely rotating the at least adjustable front housing member between two different installation positions and the rear housing member having attachment means for facilitating attachment of one or more drawer support brackets regardless of whether the vanity or cabinet is configured to be left side drawer mounting or right side drawer mounting.

It must be understood that no one embodiment of the present invention need include all the aforementioned objects of the present invention. Rather, a given embodiment may include one or none of the aforementioned objects.

Accordingly, these objects are not to be used to limit the scope of the claims of the present invention.

In summary, one preferred embodiment of the present invention is directed to a universal cabinet accommodating both left and right side drawer mountings allowing the universal cabinet to be installed in a first installation site having plumbing requiring left side drawer mounting and a second installation site requiring right side drawer mounting. The universal cabinet includes a cabinet housing having an interior space and an upper opening. The upper opening is configured to receive at least one sink operably connected to a countertop. The interior space is sized to receive an interior portion of at least one drawer and at least a portion of plumbing to be connected to the at least one sink. The cabinet housing includes a frame member having a first opening for receiving a drawer and a second opening allowing an individual to access the at least a portion of plumbing housed in the interior space of the cabinet housing. The frame member is configured to be detachably connected to at least one other member forming at least a portion of the cabinet housing. The frame member is configured to mount a drawer on a left side of the cabinet housing when an installation site requires a left side drawer mounting and a drawer mounted on a right side of the cabinet housing when an installation site requires a right side drawer mounting.

Another preferred embodiment of the present invention is directed to a universal cabinet accommodating both left and right side drawer mountings allowing the universal cabinet to be installed in a first installation site having an existing structure requiring left side drawer mounting and a second installation site having an existing structure requiring right side drawer mounting. The universal cabinet including a cabinet housing having an interior space and an upper opening. The interior space is sized to receive an interior portion of at least one drawer and provide a storage area horizontally offset from the interior portion of the at least one drawer. The cabinet housing includes a frame member having a first opening for receiving a drawer and a second opening allowing an individual to access the storage area. The frame member is configured to be detachably connected to at least one other member forming at least a portion of the cabinet housing. The frame member is configured to mount a drawer on a left side of the cabinet housing when an installation site requires a left side drawer mounting and to mount a drawer on a right side of the cabinet housing when an installation site requires a right side drawer mounting.

A further preferred embodiment of the present invention is directed to a universal cabinet accommodating both left and right side drawer mountings allowing the universal cabinet to be installed in a first installation site having an existing structure requiring left side drawer mounting and a second installation site having an existing structure requiring right side drawer mounting. The universal cabinet includes a cabinet housing having an interior space. The interior space is sized to receive an interior portion of at least one drawer and provide an interior storage area horizontally offset from the interior portion of the at least one drawer. A first drawer is configured to be slidably mounted to the cabinet housing. The cabinet housing includes a front frame member, a rear frame member and at least one side frame member. The front frame member is configured such that when installed in a first position the cabinet housing is configured to be a left side drawer mounting and when the frame member is rotated 180 degrees in a vertical plane from the first position the cabinet housing is configured to be a right side drawer mounting.

The above preferred forms of the present invention described above provide various examples of preferred embodiments of the present invention and are not to be construed as limiting the present invention to any of the preferred forms described above.

DETAILED DESCRIPTION OF THE PREFERRED EMBODIMENTS OF THE INVENTION

The preferred forms of the invention will now be described with reference to FIGS. 1-7. The appended claims are not limited to the preferred form and no term and/or phrase used herein is to be given a meaning other than its ordinary meaning unless it is expressly stated otherwise.

FIGS. 1 through 4

Referring to FIGS. 1 to 4, a vanity or cabinet A employing a preferred form of the invention is illustrated in one of many possible configurations. In the most preferred form, the vanity or cabinet A is a bathroom vanity having a vanity housing defined by two or more frame members. The vanity housing preferably includes an upper opening for receiving one or more sinks operably connected to a countertop. The countertop can be formed from any suitable material and is configured to sit on an upper horizontal surface of the vanity housing. It should be noted that one or more walls of a room may form one or more portions of the vanity housing. The bathroom vanity may include one or more drawers slidably mounted in a portion of an interior space formed by the vanity housing. Another portion of the interior space of the vanity housing horizontally offset from the portion receiving the one or more drawers may house one or more plumbing components operably connected to the one or more sinks as well as an adjustable storage shelf or other storage devices.

Figure 1:
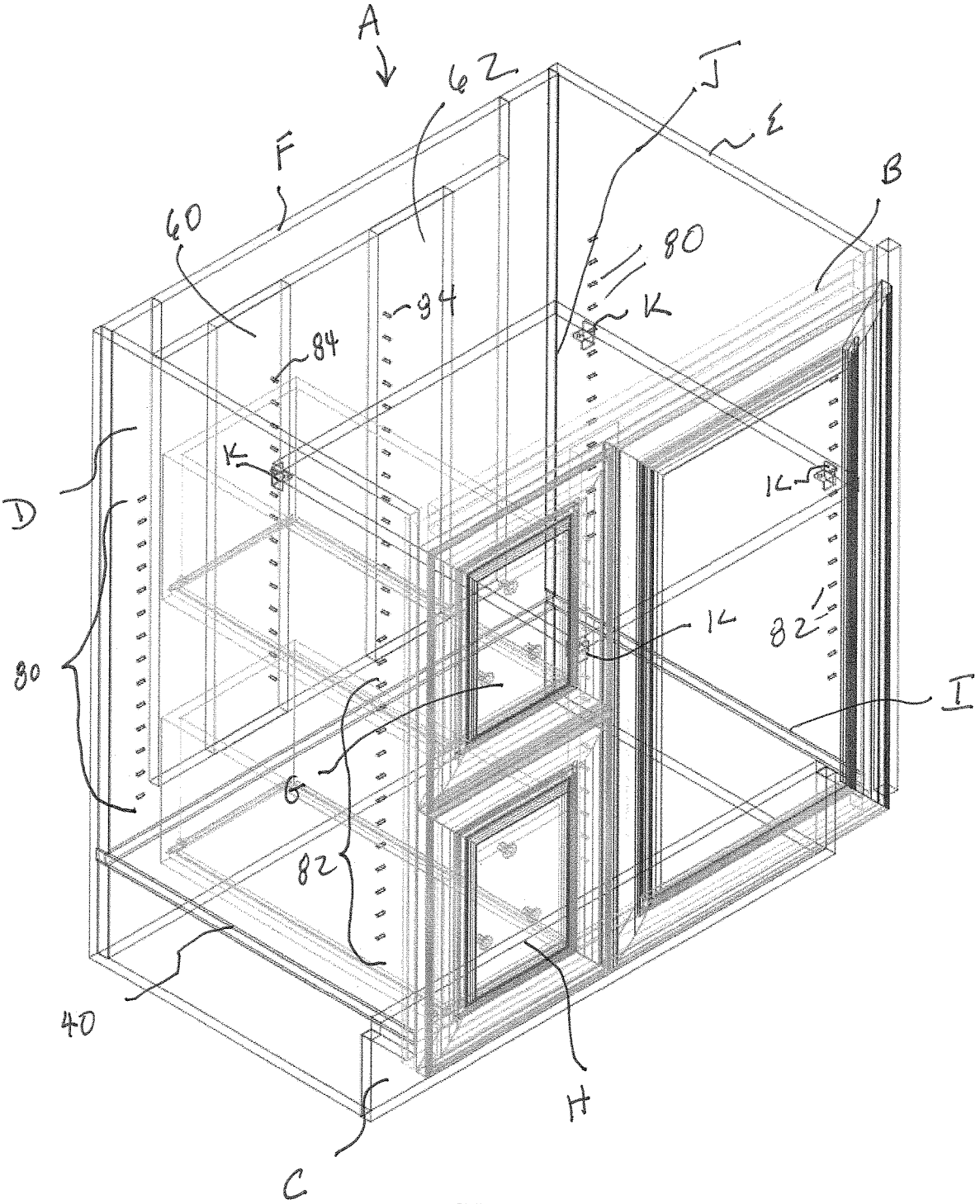
FIG. 1 is a perspective view of a vanity or cabinet formed in accordance with a preferred embodiment of the present invention.

Referring to FIG. 1, cabinet A preferably includes an upper front frame member B, a lower front frame member C, a left side frame member D, a right side frame member E and a rear frame member F. Preferably, the left side frame member D is the mirror image of the right side frame member E. These frame members can be detachably connected to adjacent frame members using any suitable fasteners. The fasteners can be interior fasteners that are not visible from the exterior of the cabinet housing when cabinet A is fully assembled including a countertop mounted on the uppermost surfaces of frame members B, D, E and F. Frame members B, D, E and F form an upper open for receiving one or more sinks operably connected to the countertop mounted on the uppermost surfaces of frame members B, D, E and F so that the one or more sinks can be connected to one or more plumbing components housed in the interior of the cabinet housing.

Side frame members D and E are notched at a lower front portion to receive lower front frame member C.

While cabinet A is shown as having two side frame members and a rear frame member, existing wall structures of a room in which cabinet A is installed may form one of the side frame members and/or the rear frame member. FIG. 1 illustrates cabinet A as having an upper drawer G and a lower drawer H slidably mounted to the cabinet housing defined by the aforementioned frame members, i.e., frame members B, C, D, E and F. While cabinet A is shown as having two drawers, the number of drawers may be readily varied as desired. For example, cabinet A may have one drawer or more than two drawers.

One or more support brackets or other mounting structures may be used to slidably connect drawers G and H to the cabinet housing so that the drawers are movable (e.g., slide) between a closed position illustrated in FIG. 1 and an open position allowing a user to place in or remove objects from either of drawers G and H. A door I may be movably connected to the cabinet housing using any suitable hinges, brackets or other mounting structure. Preferably, door I is configured to allow an individual to access existing structure (e.g., plumbing components) housed in the portion of the interior of the cabinet housing directly behind the door I. An adjustable storage shelf J may be positioned in the interior of the cabinet housing directly behind door I. Other storage devices (e.g., interior slidable storage tray) may also be positioned in the interior of the cabinet housing directly behind door I. While FIG. 1 depicts a single door, the number of doors may be readily varied as desired.

Figure 2:
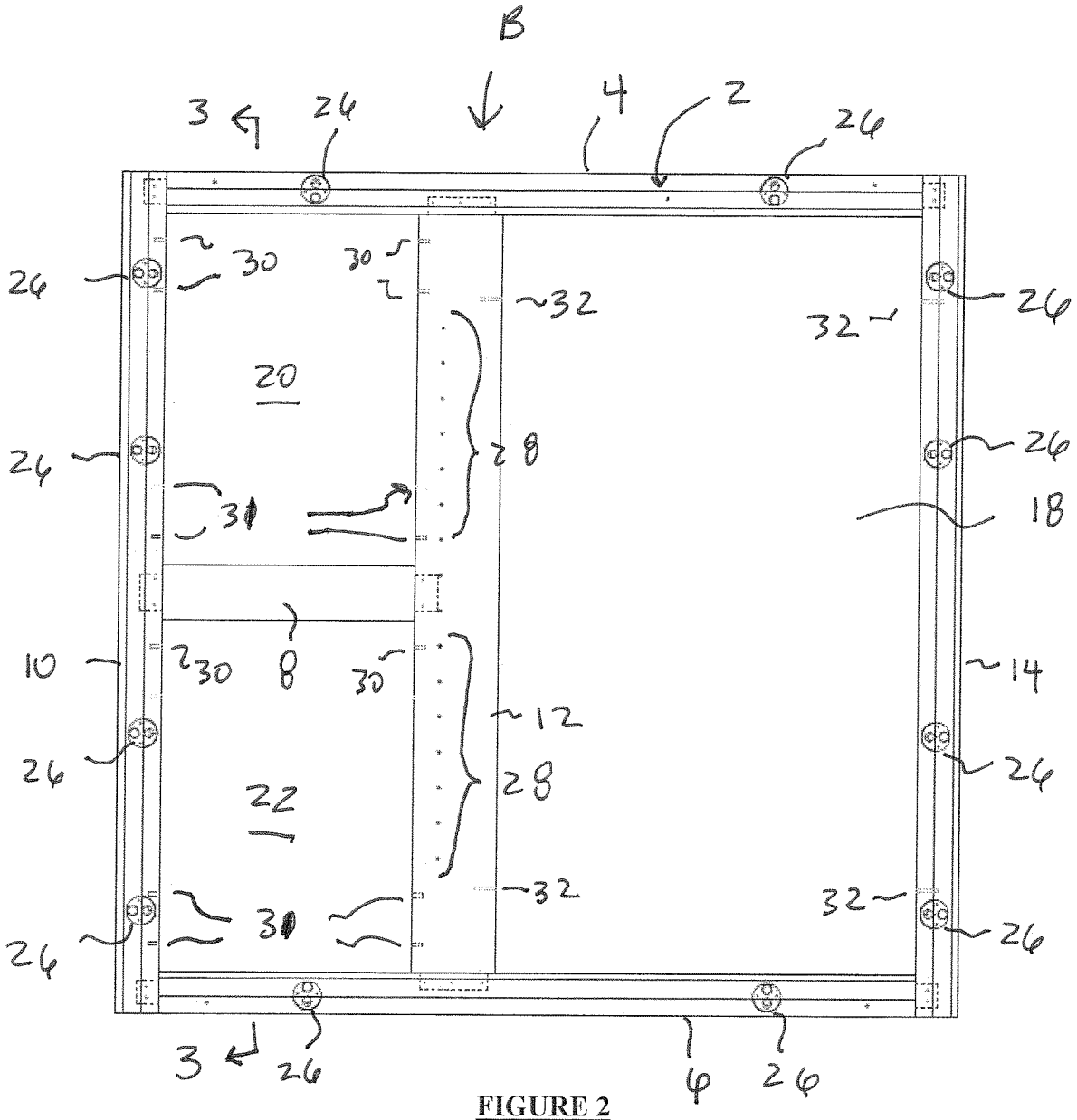
FIG. 2 is an elevational view of an interior face of a front cabinet or vanity housing member formed in accordance with a preferred embodiment of the present invention.
Figure 3:
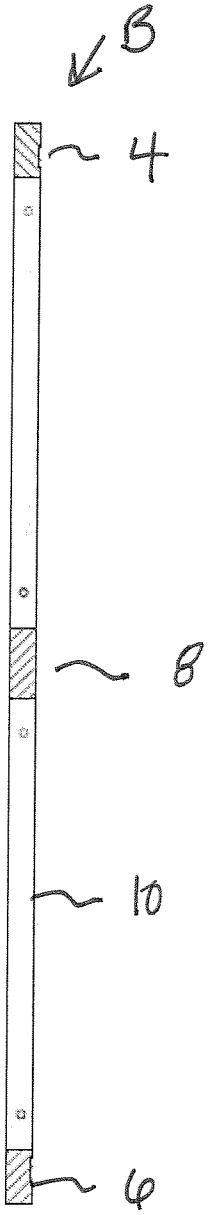
FIG. 3 is a cross-sectional view of the front housing member taken along lines 3-3 in FIG. 2.

Referring to FIG. 2, an interior surface 2 of upper front frame member B is depicted. Frame member B may be formed from multiple pieces. As illustrated in FIG. 2, frame member B includes horizontally extending members 4, 6 and 8 and vertically extending members 10, 12 and 14. Members 4, 6, 10 and 14 form a perimeter of frame member B. Members 4, 6, 12 and 14 form an opening 18 that door I covers when door I is closed. Members 4, 6, 8, 10 and 12 form openings 20 and 22 for receiving a corresponding drawer.

Members 4 and 6 include a pair of fasteners 26. Each of the fasteners 26 of member 4 are vertically aligned with a corresponding fastener 26 of member 6. Members 10 and 14 preferably include four fasteners 26. Fasteners 26 of member 10 are horizontally aligned with a corresponding fastener 26 of member 14. All fasteners 26 of members 4 and 6 are preferably identical.

Member 12 of front frame member B may include a plurality of vertically spaced openings, slots or bores 28 to receive a portion of a support bracket K or support pin for supporting an adjacent portion of adjustable shelf J. Members 10 and 12 include a plurality of vertically spaced preformed openings/slots/bores 30 (e.g., predrilled openings) configured to receive a corresponding portion of an internal sliding tray mounting bracket. Each opening 30 of member 10 is horizontally aligned with a corresponding opening 30 of member 12.

Members 10 and 12 include a plurality of vertically spaced preformed openings/slots/bores 31 (e.g., predrilled openings) configured to receive a corresponding portion of a drawer mounting bracket. Each opening 31 of member 10 is horizontally aligned with a corresponding opening 31 of member 12.

Members 12 and 14 include a plurality of vertically spaced preformed openings/slots/bores 32 (e.g., predrilled opening) configured to receive a corresponding portion of a door mounting hinge or bracket. Each opening 32 of member 12 is horizontally aligned with a corresponding opening 32 of member 14.

Referring to FIG. 1, cabinet A further includes horizontally extending bottom section 40 which mates with, abuts or directly contacts front frame member B, side frame members D and E and rear frame member F. When cabinet B is configured to be a left side drawer mounting cabinet, fasteners 26 of member 4 will each engage a suitably configured fastener extending from or attached to a front face of bottom section 40 to detachably connect a lower end of front frame member B to the front face of bottom section 40. When cabinet B is configured to be a right side drawer mounting cabinet, fasteners 26 of member 6 will each engage a suitably configured fastener extending from or attached to a front face of bottom section 40 to detachably connect a lower end of front frame member B to the front face of bottom section 40.

Frame member B is configured such that rotation of frame member B 180 degrees in a vertical plane from the position illustrated in FIG. 1 changes cabinet B from a left side drawer mounting cabinet depicted in FIG. 1 to a right side drawer mounting cabinet. By this configuration, the significant problems discussed above regarding ordering or shipping the incorrect drawer side mounted cabinet/vanity are completely eliminated as cabinet A can be either a right side or left side drawer mounting cabinet as desired by the user or as dictated by existing structure (e.g., one or more plumbing components) of the installation site merely by rotating frame member B 180 degrees in a vertical plane.

Members 4 and 6 are preferably identical or substantially identical including any and all fasteners or fastening components associated with these members. Members 10 and 14 are also identical or substantially identical including any and all fasteners or fastening components associated with these members. This configuration allows either member 4 or member 6 to be detachably connected to a front face of bottom section 40 without altering members 4 and 6 or bottom section 40 including any fasteners associated therewith. This configuration of members 10 and 14 allows either member to be detachably connected to the left side frame member D or the right side frame member E without altering members 10 and 14 and without altering the left side frame member D or the right side frame member E including any fasteners associated therewith.

Figure 4:
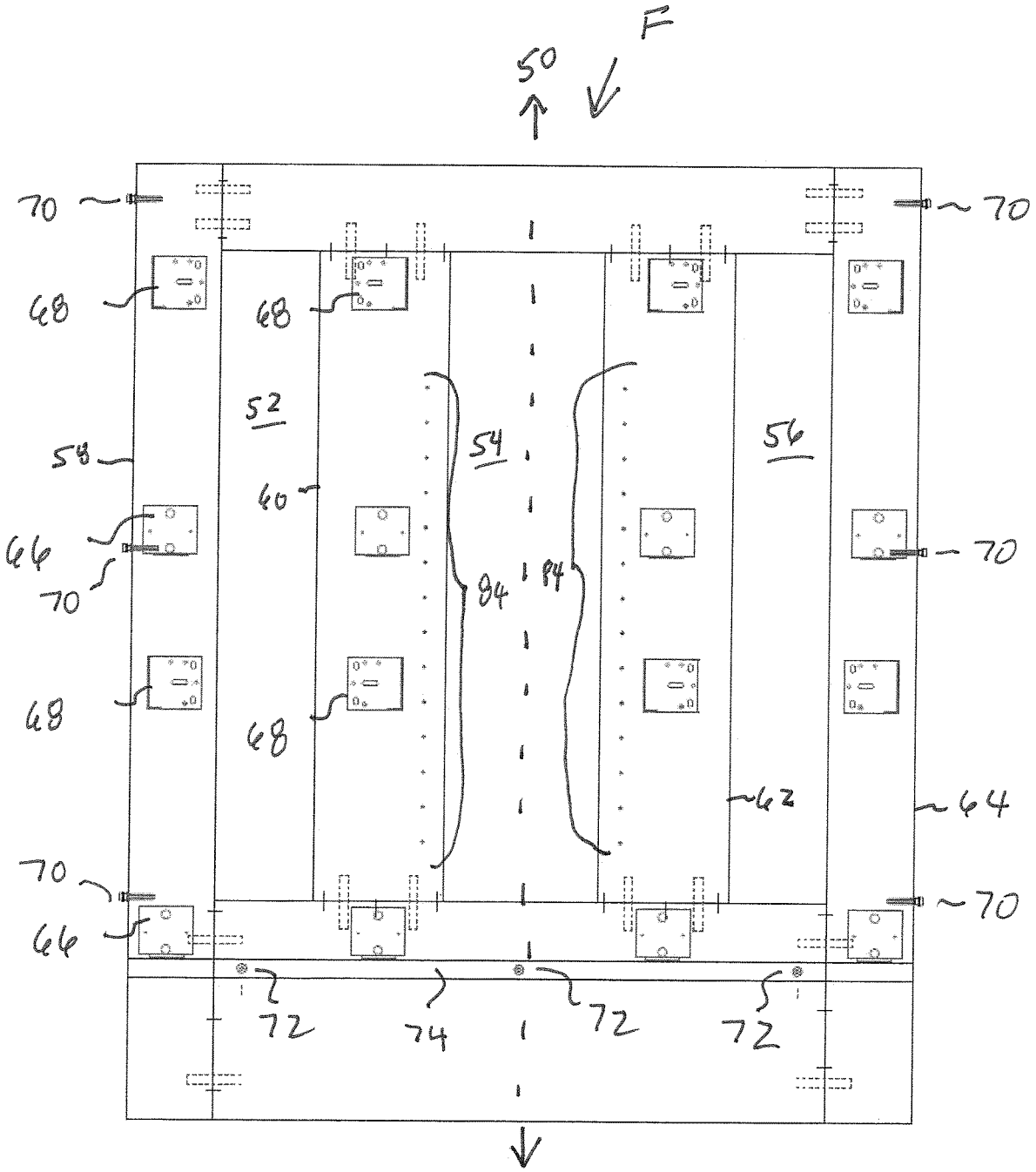
FIG. 4 is an elevational view of an interior face of a rear cabinet or vanity housing member formed in accordance with a preferred embodiment of the present invention.

Referring to FIG. 4, rear frame member F is configured to be symmetrical about a vertical axis 50 extending through the middle of frame member F. This configuration allows for the rear panel to connect also necessary components regardless of whether cabinet A is configured to be a right side or left side drawer mounting cabinet. In either drawer mounting, rear frame member F remains in the position illustrated in FIGS. 1 and 4. Rear frame member F can be formed from multiple pieces the number of which can be readily varied as desired.

Rear frame member F includes enlarged openings 52, 54 and 56. Openings 52 and 56 are preferably identical in size and shape. Opening 54 is preferably larger than openings 52 and 56. These openings allow for existing plumbing components to extend into the interior of the cabinet housing.

Vertically extending members 58, 60, 62 and 64 include preformed attachment means 66 to receive a portion of a corresponding drawer mounting bracket. The attachment means 66 can be preformed openings, bores, slots and/or mounting plates. The attachment means 66 allow drawer support brackets to be connected to rear panel member F when cabinet A is configured to be a right side drawer mounting cabinet and when cabinet A is configured to be a left side drawer mounting cabinet. Vertically extending members 58, 60, 62 and 64 may also include preformed attachment means 68 to receive a portion of an internal tray mounting bracket so that each drawer may have an internal sliding tray. Vertically extending members 58 and 64 also preferably includes three vertically spaced fasteners 70 for detachably connecting rear frame member F to side frame members D and E. Fasteners 70 can take any suitable form. Front frame member B may include similar fasteners to detachably connect frame member B to side frame members D and E.

Attachment means 72 may be formed in a notched or recessed lower section 74 that receives a rear portion of bottom section 40 to detachably connect bottom section 40 to rear frame member F. The attachment means 72 can be performed opening, slots, bores, recesses, etc. that receive a fastener extending outwardly from a rear face of bottom section 40. For example, the rear face of bottom section 40 may include a plurality of dowels that are received in bores 72.

Referring to FIG. 1, side members D and E each include a first set of a plurality of vertically spaced openings 80 and a second set of a plurality of vertically spaced openings 82 to receive a corresponding adjustable shelf support bracket to allow mounting of the adjustable shelf J in either the left side or right side of the interior space of the cabinet housing. Similarly, as seen in FIG. 4, members 60 and 62 of rear frame member F each include a set of a plurality of vertically spaced openings 84 to allow mounting of the adjustable shelf J in either the left side or right side of the interior space of the cabinet housing. As is seen in FIG. 1, when the shelf J is mounted on the right side, an opening 84 formed in member 60 is used to receive a corresponding shelf support to support the rear, left edge of shelf J. When the shelf J is mounted on the left side, an opening 84 formed in member 62 is used to receive a corresponding shelf support to support the rear, right edge of shelf J.

Figure 5:
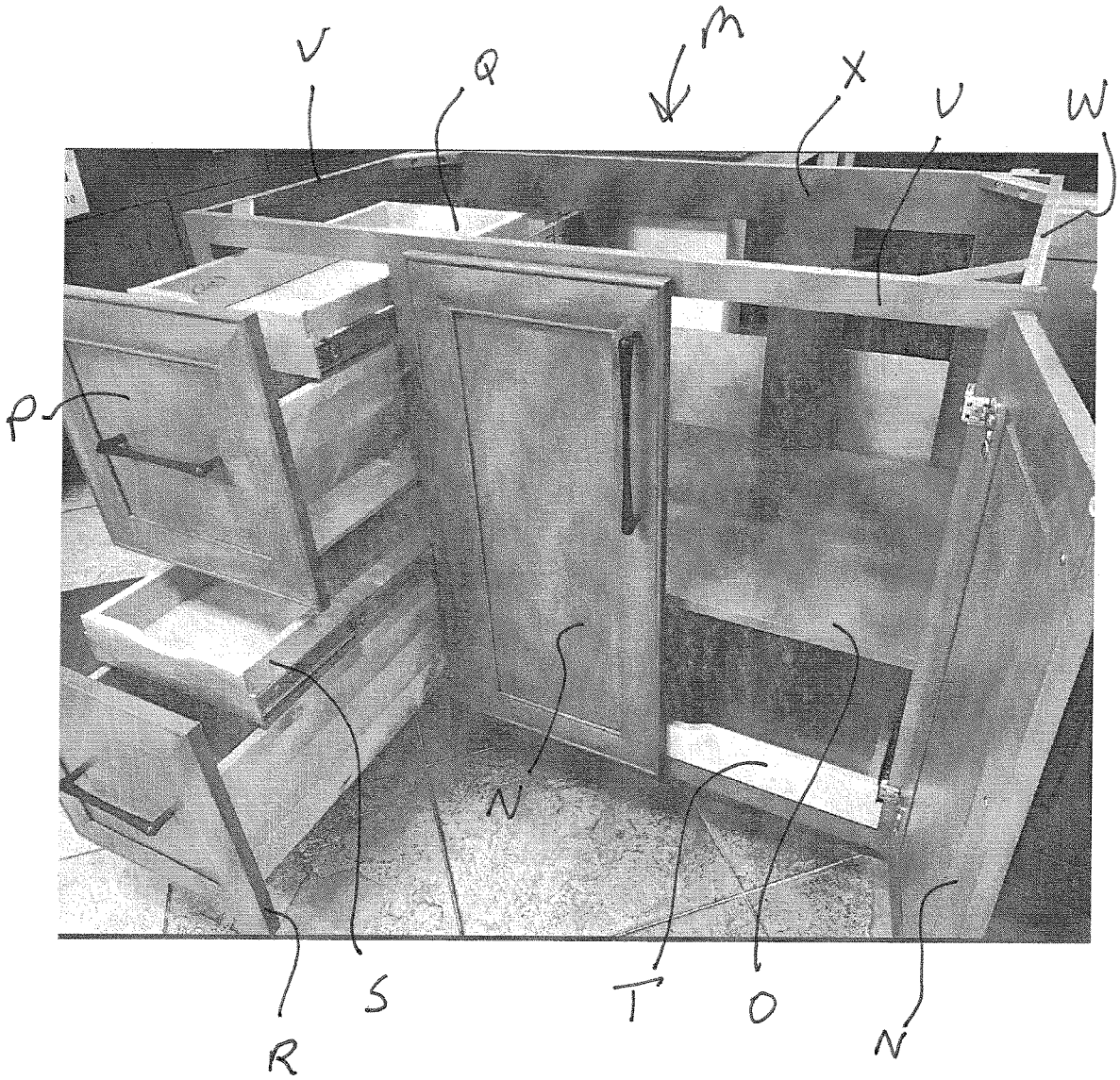
FIG. 5 is a perspective view of a vanity or cabinet formed in accordance with another preferred embodiment of the present invention.
Figure 6:
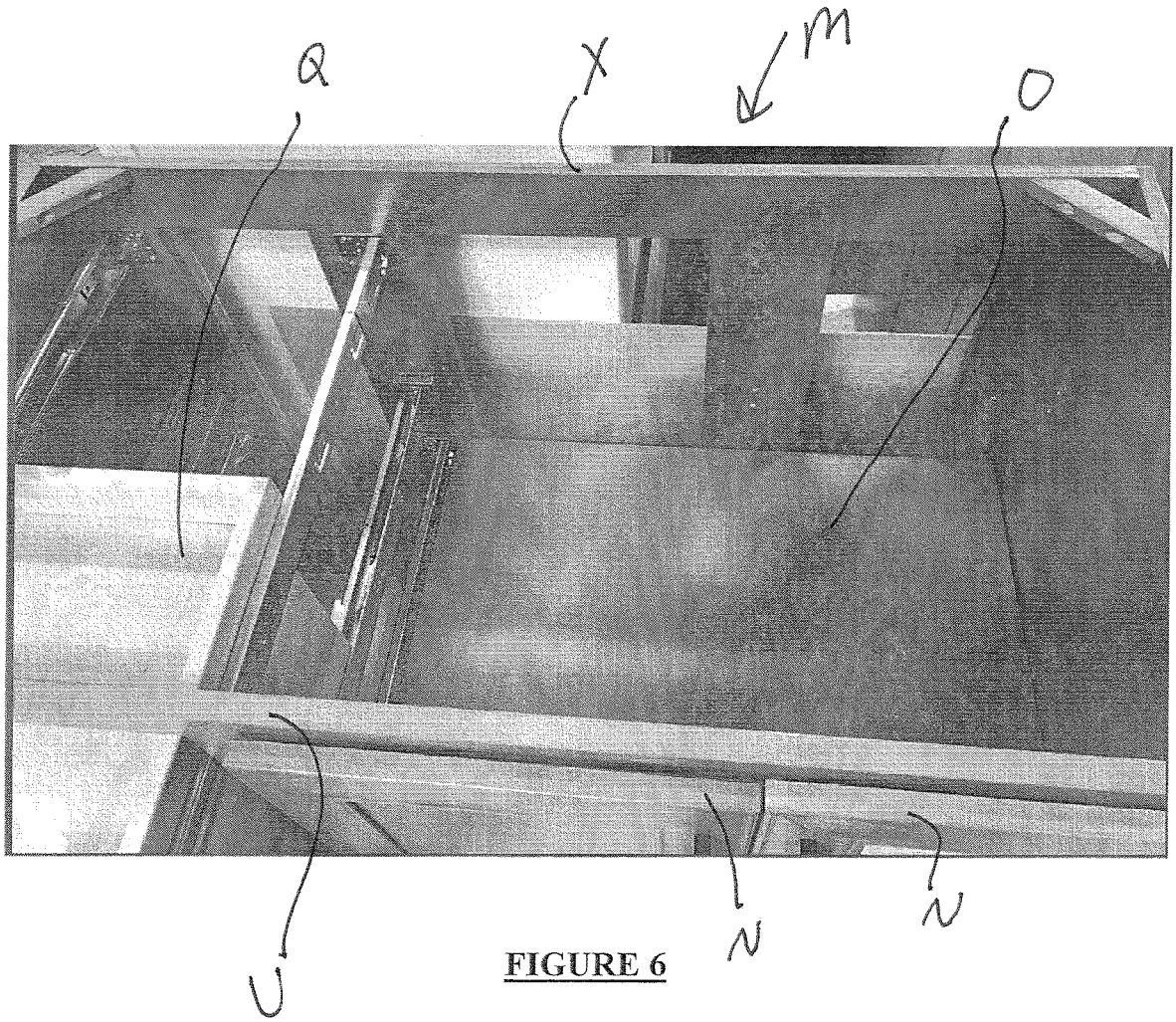
FIG. 6 is a perspective view of an upper portion of the vanity or cabinet illustrated in FIG. 5.
Figure 7:
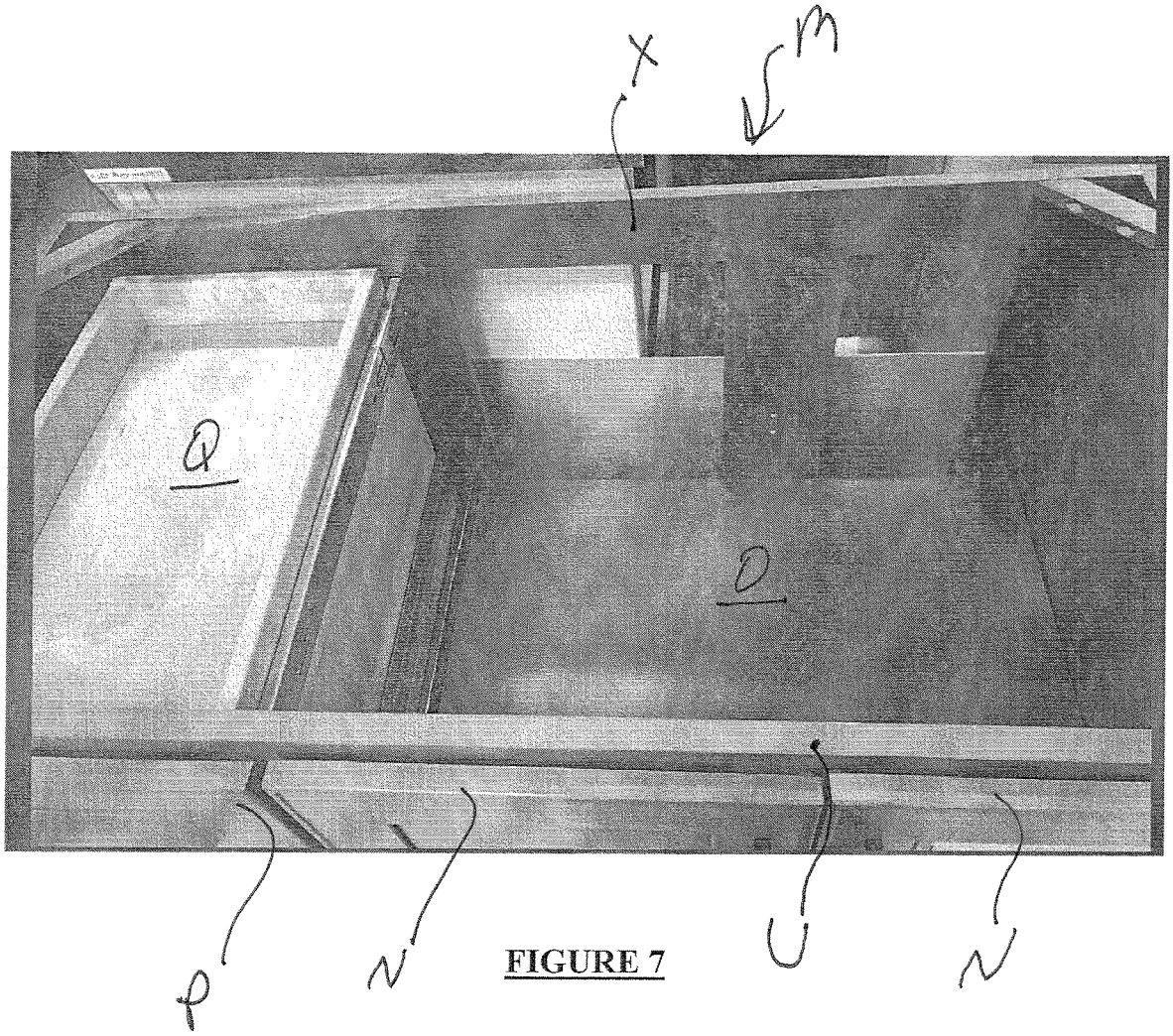
FIG. 7 is a perspective view of an upper portion of the vanity or cabinet illustrated in FIG. 5 with the drawers in a closed position.

FIGS. 5 through 7

FIGS. 5 to 7 depict a vanity or cabinet M which is similar to vanity or cabinet A previously described. Cabinet M includes a pair of doors N, an adjustable shelf O, upper drawer P having an internal sliding tray Q, lower drawer R having an internal sliding tray S and an interior tray T disposed below adjustable shelf O. Front frame member U, side members V and W and rear frame member X are configured similar to the corresponding frame members of cabinet A so that the drawers and corresponding internal sliding trays can be mounted on the left or right side of the cabinet housing with the doors N, adjustable shelf O and interior tray T can be disposed on the other side of the cabinet housing, i.e., the side of the housing that is horizontally offset from the side of the housing having the drawers and internal sliding trays.

As is readily evident from the above discussion, both cabinets A and M allow an individual to configure the corresponding cabinet to be a left side or right side drawer mounting cabinet without the individual machining or otherwise altering the physical make-up of the components of the cabinets A and M. The individual is not even required to drill new or additional holes or openings. Rather, an individual need only rotate the front frame member in a vertical plane 180 degrees to change the cabinet from a left to a right side drawer mounting cabinet. The front frame member, side frame members and rear frame member are all preferably preformed and configured so that the positions of drawers including any internally sliding trays, the doors, the adjustable shelf and all corresponding mounting components (e.g., door hinges, drawer mounting brackets) can be attached or mounted on or to the corresponding portion of the cabinet when the cabinet is a left side drawer mounting cabinet or a right side drawer mounting cabinet without the individual altering the physical composition of the components of the cabinets from the form of the components supplied to the individual from the cabinet supplier. For example, the individual need not cut any component of drill additional holes or openings in any component to change the side the drawers are mounted on the cabinet housing.

It should be noted that each of the components of the cabinets A and M described above can be formed from any suitable material. Cabinets A and/or M can be shipped from the supplier, distributor or manufacturer fully assembled, partially assembled or disassembled. If shipped fully assembled, the detachable nature of corresponding components will readily allow the installer to change the drawer side mounting of the cabinet by merely disassembling the corresponding components and reinstalling the components in the alternate configuration/position. The cabinets A and/or M can be shipped with the door or doors, drawer or drawers, adjustable shelf and front frame member detached from a partially assembled cabinet housing so that the installer can attach the front frame member and other components to the partially assembled cabinet housing to create a cabinet having the drawer or drawers mounted on a side desired by the customer or dictated by the existing structure of the installation site.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A universal cabinet accommodating both left and right side drawer mountings allowing the universal cabinet to be installed in a first installation site having plumbing requiring left side drawer mounting and a second installation site requiring right side drawer mounting, said universal cabinet, comprising:

(a) a cabinet housing having an interior space and an upper opening, said upper opening being configured to receive at least one sink operably connected to a countertop, said interior space is sized to receive an interior portion of at least one drawer and at least a portion of plumbing to be connected to the at least one sink;

(b) said cabinet housing including a bottom frame member and a front frame member, said front frame member having a first horizontally extending member, a second horizontally extending member, a first vertically extending member, a second vertically extending member and a third vertically extending member positioned between said first vertically extending member and said second vertically extending member, said first horizontally extending member, said second horizontally extending member, said first vertically extending member and said second vertically extending member being interconnected and forming an outer periphery of said front frame member, said front frame member having a first opening for receiving a drawer and a second opening allowing an individual to access the at least a portion of plumbing housed in the interior space of the cabinet housing when the universal cabinet is installed, said first opening being formed between said first vertically extending member and said third vertically extending member, said second opening being formed between said second vertically extending member and said third vertically extending member, said first horizontally extending member including a first fastener configured to connect said first horizontally extending member to said bottom frame member and said second horizontally extending member including a second fastener configured to connect said second horizontally extending member to said bottom frame member, said first fastener being vertically aligned with said second fastener when said front frame member is connected to said bottom frame member and said first fastener being identical to said second fastener, said first horizontally extending member of said front frame member being configured to be detachably connected to said bottom frame member by said first fastener of said first horizontally extending member when a left side drawer mounting is required and said second horizontally extending member of said front frame member being configured to be detachably connected to said bottom frame member by said second fastener of said second horizontally extending member when a right side drawer mounting is required and wherein said front frame member being configured such that upon rotation of said front frame member 180 degrees in a vertical plane a drawer mounting side of said universal cabinet can be changed from one side of the universal cabinet to another side of the universal cabinet.

2. The universal cabinet as recited in claim 1, further including:

(a) at least a first door movably mounted to said cabinet housing adjacent said second opening so that said at least a first door can move between a closed position and an open position, said at least a first door being sized to completely cover said second opening when said at least a first door is in the closed position; and, (b) at least a first drawer slidably connected to said cabinet housing so that said at least a first drawer can slide in said first opening between an open position and a closed position.

3. The universal cabinet as recited in claim 2, further including:

(a) at least a first mounting bracket positioned in said interior of said cabinet housing adjacent said first opening and operably connected to a first drawer so that said first drawer can slide horizontally between the open position and the closed position.

4. The universal cabinet as recited in claim 3, wherein:

(a) said cabinet housing includes a rear frame member forming a rear portion of said cabinet housing, said rear frame member including a first attachment means for connecting a rear portion of said first mounting bracket to said rear frame member when said first drawer is mounted on a left side of said cabinet housing and a second attachment means for connecting a rear portion of said first mounting bracket to said rear frame member when said first drawer is mounted on a right side of said cabinet housing.

5. The universal cabinet as recited in claim 4, wherein:

(a) said first attachment means is identical to said second attachment means.

6. The universal cabinet as recited in claim 4, wherein:

(a) said first attachment means includes at least one preformed opening formed in said rear frame member prior to shipment of said cabinet housing to a customer and said second attachment means includes at least one preformed opening formed in said rear frame member prior to shipment of said cabinet housing to a customer, said at least one preformed opening of said first attachment means is spaced from and horizontally aligned with said at least one preformed opening of said second attachment means.

7. A universal cabinet accommodating both left and right side drawer mountings allowing the universal cabinet to be installed in a first installation site having an existing structure requiring left side drawer mounting and a second installation site having an existing structure requiring right side drawer mounting, said universal cabinet, comprising:

(a) a cabinet housing having an interior space and an upper opening, said interior space is sized to receive an interior portion of at least one drawer and provide a storage area horizontally offset from the interior portion of the at least one drawer;

(b) said cabinet housing including a left side frame member, a right side frame member and a front frame member, said front frame member having a first horizontally extending member, a second horizontally extending member, a first vertically extending member, a second vertically extending member and a third vertically extending member positioned between said first vertically extending member and said second vertically extending member, said first horizontally extending member, said second horizontally extending member, said first vertically extending member and said second vertically extending member being interconnected and forming an outer periphery of said front frame member, said front frame member having a first opening for receiving a drawer and a second opening allowing an individual to access the storage area, said front frame member being configured to be detachably connected to said left side frame member and said right side member, said first vertically extending member having a first fastener and said second vertically extending member having a second fastener, said first fastener being horizontally aligned with said second fastener when said front frame member is installed, said first fastener being identical to said second fastener, when a left side drawer mounting is required said first vertically extending member of said front frame member being configured to be detachably connected to said left side frame member by said first fastener of said first vertically extending member and said second vertically extending member of said front frame member being configured to be detachably connected to said right side frame member by said second fastener and when a right side drawer mounting is required said second vertically extending member of said front frame member being configured to be detachably connected to said left side frame member by said second fastener of said second vertically extending member and said first vertically extending member being configured to be detachably connected to said right side frame member by said first fastener of said first vertically extending member and wherein said front frame member being configured such that upon rotation of said front frame member 180 degrees in a vertical plane a drawer mounting side of said universal cabinet can be changed from one side of the universal cabinet to another side of the universal cabinet.

8. The universal cabinet as recited in claim 7, wherein:

(a) the cabinet housing when installed includes one or more plumbing components in the storage area.

9. The universal cabinet as recited in claim 7, further including:

(a) at least a first door movably mounted to said cabinet housing adjacent said second opening so that said at least a first door can move between a closed position and an open position, said at least a first door being sized to completely cover said second opening when said at least a first door is in the closed position; and, (b) at least a first drawer slidably connected to said cabinet housing so that said at least a first drawer can slide in said first opening between an open position and a closed position;

(c) at least a first mounting bracket positioned in said interior of said cabinet housing adjacent said first opening and operably connected to a first drawer so that said first drawer can slide horizontally between the open position and the closed position; and, (d) said cabinet housing includes a rear frame member forming a rear portion of said cabinet housing, said rear frame member including a first attachment means for connecting a rear portion of said first mounting bracket to said rear frame member when said first drawer is mounted on a left side of said cabinet housing and a second attachment means for connecting a rear portion of said first mounting bracket to said rear frame member when said first drawer is mounted on a right side of said cabinet housing, said first attachment means is identical to said second attachment means.

10. The universal cabinet recited in claim 9, wherein:

(a) said front frame member has a finished exterior surface and an unfinished interior surface wherein said exterior finished surface forms an exterior of said cabinet housing when said front frame member is installed in a first position for a left side drawer mounting and when said front frame member is installed in a second position for a right side drawer mounting.

11. The universal cabinet recited in claim 10, wherein:

(a) said first attachment means includes at least one preformed opening formed in said rear frame member prior to shipment of said cabinet housing to a customer and said second attachment means includes at least one preformed opening formed in said rear frame member prior to shipment of said cabinet housing to a customer, said at least one preformed opening of said first attachment means is spaced from and horizontally aligned with said at least one preformed opening of said second attachment means.

12. The universal cabinet recited in claim 11, wherein:

(a) said front frame member includes a third horizontally extending member, said third horizontally extending member having a length less than each of a length of said first horizontally extending member and a length of said second horizontally extending member, said third horizontally extending member is disposed between said first horizontally extending member and said second horizontally extending member and a first end of said third horizontally extending member is connected to said first vertically extending member and a second end of said third horizontally extending is connected to said third vertically extending member to form two drawer openings between said first vertically extending member and said third vertically extending member.

13. A universal cabinet accommodating both left and right side drawer mountings allowing the universal cabinet to be installed in a first installation site having an existing structure requiring left side drawer mounting and a second installation site having an existing structure requiring right side drawer mounting, said universal cabinet, comprising:

(a) a cabinet housing having an interior space, said interior space is sized to receive an interior portion of at least one drawer and provide an interior storage area horizontally offset from the interior portion of the at least one drawer;

(b) a first drawer configured to be slidably mounted to said cabinet housing;

(c) said cabinet housing including a front frame member, a bottom frame member, a rear frame member, a left side frame member and a right side frame member, said front frame member having a first horizontally extending member, a second horizontally extending member, a first vertically extending member, a second vertically extending member and a third vertically extending member positioned between said first vertically extending member and said second vertically extending member, said first horizontally extending member, said second horizontally extending member, said first vertically extending member and said second vertically extending member being interconnected and forming an outer periphery of said front frame member, said first horizontally extending member including a first fastener and said second horizontally extending member including a second fastener, said first fastener being vertically aligned with said second fastener when said front frame member is installed, said first vertically extending member having a third fastener and said second vertically extending member having a fourth fastener, said third fastener being horizontally aligned with said fourth fastener when said front frame member is installed, said third fastener being identical to said fourth fastener, when a left side drawer mounting is required said first vertically extending member of said front frame member being configured to be detachably connected to said left side frame member by said third fastener of said first vertically extending member, said second vertically extending member of said front frame member being configured to be detachably connected to said right side frame member by said fourth fastener and said second horizontally extending member being configured to be detachably connected to said bottom frame member by said second fastener of said second horizontally extending member and when a right side drawer mounting is required said second vertically extending member of said front frame member being configured to be detachably connected to said left side frame member by said fourth fastener of said second vertically extending member, said first vertically extending member being configured to be detachably connected to said right side frame member by said third fastener of said first vertically extending member and said first horizontally extending member being configured to be detachably connected to said bottom frame member by said first fastener of said first horizontally extending member and wherein said front frame member being configured such that upon rotation of said front frame member 180 degrees in a vertical plane a drawer mounting side of said universal cabinet can be changed from one side of the cabinet to another side of the cabinet without forming new holes or openings in any of said front frame member, said bottom frame member, said left side member and said right side frame member and without altering a physical composition of any components of the cabinet.

14. The universal cabinet recited in claim 13, wherein:

(a) said front frame member includes a third horizontally extending member, said third horizontally extending member having a length less than each of a length of said first horizontally extending member and a length of said second horizontally extending member, said third horizontally extending member is disposed between said first horizontally extending member and said second horizontally extending member.

15. The universal cabinet recited in claim 14, further including:

(a) a second drawer configured to be slidably mounted to said cabinet housing.

16. The universal cabinet recited in claim 15, wherein:

(a) said second drawer is positioned below said first drawer.

17. The universal cabinet recited in claim 13, wherein:

(a) said front frame member has a finished exterior surface and an unfinished interior surface wherein said exterior finished surface forms an exterior of said cabinet housing when said front frame member is installed in a first position for a left side drawer mounting and when said front frame member is installed in a second position for a right side drawer mounting.

18. The universal cabinet recited in claim 16, wherein:

(a) a first end of said third horizontally extending member is connected to said first vertically extending member and a second end of said third horizontally extending is connected to said third vertically extending member to form two vertically aligned drawer openings between said first vertically extending member and said third vertically extending member.

19. The universal cabinet as recited in claim 18, wherein:

(a) said rear frame member includes a first attachment means for connecting a rear portion of a first drawer mounting bracket to said rear frame member when said first drawer is mounted on a left side of said cabinet housing and a second attachment means for connecting a rear portion of said first drawer mounting bracket to said rear frame member when said first drawer is mounted on a right side of said cabinet housing.

20. The universal cabinet as recited in claim 19, wherein:

(a) said first attachment means includes at least one preformed opening formed in said rear frame member prior to shipment of said cabinet housing to a customer and said second attachment means includes at least one preformed opening formed in said rear frame member prior to shipment of said cabinet housing to a customer, said at least one preformed opening of said first attachment means is spaced from and horizontally aligned with said at least one preformed opening of said second attachment means.

* * * * *